US005422614A

United States Patent [19]

Rampalli et al.

[11] Patent Number: 5,422,614

[45] Date of Patent: Jun. 6, 1995

[54] RADIATING COAXIAL CABLE FOR PLENUM APPLICATIONS

[75] Inventors: Sitaram Rampalli, Orland Park; Leonard J. Visser, Frankfort, both of Ill.

[73] Assignee: Andrew Corporation, Orland Park, Ill.

[21] Appl. No.: 23,611

[22] Filed: Feb. 26, 1993

[51] Int. Cl.[6] ..... H01P 3/02; H01Q 13/22

[52] U.S. Cl. ..... 333/237; 174/121 A

[58] Field of Search ..... 333/237; 343/770; 156/48, 53; 174/121 A, 121 SR, 110 FC

[56] References Cited

U.S. PATENT DOCUMENTS

| | | | |
|---|---|---|---|
| 3,413,640 | 11/1968 | Freeman et al. | 343/771 |
| 3,691,488 | 9/1972 | Holtum | 333/237 |
| 4,280,225 | 7/1981 | Willis | 333/237 X |
| 4,456,654 | 6/1984 | Kotian | 174/120 SR X |
| 4,500,748 | 2/1985 | Klein | 174/121 A |
| 4,510,348 | 4/1985 | Arroyo et al. | 174/121 A |
| 4,595,793 | 6/1986 | Arroyo et al. | 174/121 A |
| 4,605,818 | 8/1986 | Arroyo et al. | 174/107 |
| 4,687,294 | 8/1987 | Angeles | 174/121 A X |
| 4,780,695 | 10/1988 | Watari et al. | 333/237 |
| 4,800,351 | 1/1989 | Rampalli et al. | 333/237 |
| 4,810,835 | 3/1989 | Richter et al. | 174/107 |
| 4,969,706 | 11/1990 | Hardin et al. | 174/110 FC X |

FOREIGN PATENT DOCUMENTS

| | | | |
|---|---|---|---|
| 2807084 | 2/1978 | Germany . | |
| 57115003 | 7/1982 | Japan . | |
| 109607 | 4/1989 | Japan | 333/237 |
| 728496 | 4/1955 | United Kingdom . | |
| WO8500689 | 2/1985 | WIPO . | |
| WO8603329 | 6/1986 | WIPO . | |

OTHER PUBLICATIONS

Shindo, T. et al; "Development of fire protected Coaxial Cable": *Journal of Japan Electrical Cables;* vol. 60, Sep. 1975; pp. 25–30.

Firox ® Brochure, "The Unique Insulation For Fire--Proof Cables".

Hitachi Brochure, "Hitachi Leaky Coaxial Cable".

Haag, et al., "Leaky Coaxial Cables For Mobile Communications", *International Wire & Cable Symposium Proceedings,* pp. 286–294 (1989) Suhner Brochure, Radiating RF Cables.

Pedersen et al., "Low-smoke, Halogenfree Ship-Offshore/Onshore Cables With Improved Flame Retardance and Fire Resistance", *International Wire & Cable Symposium Proceedings,* pp. 200–205 (1983).

Bertsch et al., "New Mica Paper Insulation For Fire Resistant Cables", Cogebi, Belgium.

Palmer et al., "Light Weight Polyamide Film/Mica Marine Cable", *International Wire & Cable Symposium Proceedings,* pp. 250–254 (1985).

Pedersen, "Halogenfree Cables for Ships and Offshore Oil Platforms", *Electrical Communication,* vol. 59, No. 4, pp. 365–368 (1985).

Yu. N. Zhigulin et al., "Locating A Leak In A Pipeline By Means Of A Coaxial Test Cable", *Translated from Izmeritel'naya Teknika,* No. 5, pp. 40–41 (May, 1975).

Og. 7 of BICC Catalog, Cableselector No. E28.

Rampalli et al., "Recent Advances in the Designs of Radiating (Leaky) Coaxial Cables", *International Wire & Cable Symposium Proceedings,* pp. 66–77 (1991).

*Primary Examiner*—Benny T. Lee

*Attorney, Agent, or Firm*—Arnold, White & Durkee

[57] ABSTRACT

A radiating air-dielectric coaxial cable for plenum applications comprises an inner conductor; a non-halogenated dielectric spacer around the inner conductor; and a single, continuous, outer conductor surrounding the dielectric spacer in direct contact therewith. The outer conductor has apertures along its length for the passage of electromagnetic radiation. At least one layer of inert, flame-retardant barrier tape is wrapped over the outer surface of the outer conductor so as to cover each of the radiating apertures of said outer conductor to prevent the dielectric spacer from flowing out through the radiating apertures when the dielectric material is melted. A jacket of halogenated, highly flame-retardant polymer is extruded over the wrapped layer of barrier tape.

14 Claims, 1 Drawing Sheet

RADIATING COAXIAL CABLE FOR PLENUM APPLICATIONS

FIELD OF THE INVENTION

The present invention generally relates to radiating coaxial cables suitable for use in plenum applications.

BACKGROUND OF THE INVENTION

As is well-known, radiating coaxial cables present a special problem in meeting fire safety tests because of the numerous holes that must be provided in the outer conductor of a radiating cable. In addition to allowing the cable to radiate, these holes allow the molten polymer insulation to flow out of the cable, in the event of a fire.

The most stringent fire safety test to be met by radiating cables is the test required for plenum applications, which is the Flame Test described in Standard UL 910, also known as the "Steiner Tunnel" test for plenum cables. The only radiating coaxial cables which are known to pass the above test are those which use a fluoropolymer for both the external jacket and a foam dielectric between the inner and outer conductors. Fluoropolymers have an inherently high level of flame resistance. However, fluoropolymers present other problems because they generate large amounts of toxic fumes and corrosive gases when burned.

SUMMARY OF THE INVENTION

It is a primary object of the present invention to provide an improved radiating coaxial cable which is suitable for plenum applications and which greatly reduces the amount of toxic fumes and corrosive gases produced in a fire.

It is another object of this invention to provide such an improved radiating coaxial cable which is suitable for plenum applications and has superior electrical properties, such as low signal attenuation.

One specific object of the invention is to provide a radiating coaxial cable which is suitable for plenum applications but is free of fluoropolymers in the interior space between the inner and outer conductors.

A further object of the invention is to provide an improved radiating coaxial cable which is suitable for plenum applications and which can be efficiently and economically manufactured.

Other objects and advantages of the invention will be apparent from the following detailed description and the accompanying drawings.

In accordance with the present invention, the foregoing objectives are realized by providing a radiating air-dielectric coaxial cable comprising an inner conductor, a dielectric spacer around the inner conductor, an outer conductor surrounding the dielectric spacer in direct contact therewith, the outer conductor having apertures along its length for the passage of electromagnetic radiation, at least one layer of inert, fire-retardant barrier tape wrapped over the outer surface of the outer conductor so as to cover each of the radiating apertures to prevent the dielectric spacer from flowing out through the radiating apertures when the dielectric material is melted, and a jacket of highly flame-retardant polymer extruded over the wrapped layer of tape.

The dielectric spacer is made of a non-halogenated, non-flame-retardant polymer, preferably a polyolefin. A particularly preferred polyolefin is low density polyethylene.

The barrier tape is preferably a particulate refractory material affixed by a heat-resistant binder to a carrier material.

BRIEF DESCRIPTION OF THE DRAWING

In the drawing (i.e., FIG. 1), the single FIGURE (i.e., FIG. 1) is a perspective view of a radiating coaxial cable embodying the present invention, with successive layers of the cable removed from one end to show the internal structure.

DETAILED DESCRIPTION OF THE PREFERRED EMBODIMENTS

Figure 1:
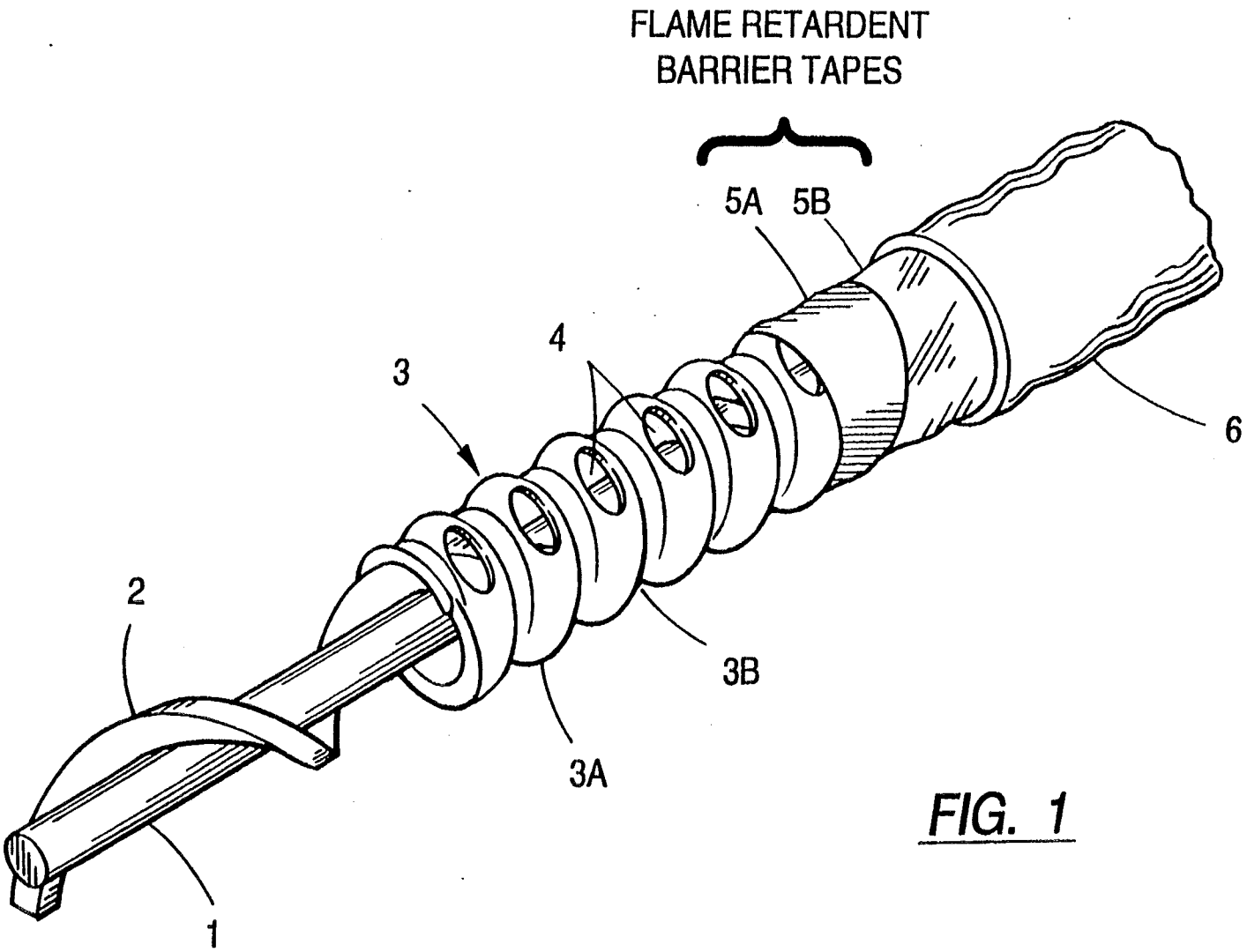

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of this invention as defined by the appended claims.

As shown in the drawing (i.e., FIG. 1), the radiating cable comprises an inner conductor 1 at the center of the cable. The conductor 1 is generally a smooth or corrugated conducting material such as copper, aluminum or copper-clad aluminum. The inner conductor 1 is surrounded by a dielectric spacer 2 in the shape of a spiral. The dielectric spacer 2 is made of a polymeric material which has a low dielectric loss so that it does not significantly attenuate the signals propagated through the cable. Although the dielectric spacer in an air-dielectric cable occupies only a small percentage of the annular space between the inner and outer conductors, e.g., less than 5% of the space, it is nevertheless desirable to minimize the dielectric loss introduced by the spacer to provide the best possible electrical characteristics for the cable.

It is preferred that the dielectric material used to form the spacer 2 be a non-halogenated, non-flame-retardant material, preferably a polyolefin such as low density polyethylene. The additives that are used to make a dielectric polymer flame-retardant tend to increase the dielectric loss, and thus it is preferred to use a dielectric material which does not contain flame-retardant additives. Crosslinking of a polymer can also improve its fire-retardant properties, but also has an adverse effect on the transmission characteristics of the cable and, therefore, is undesirable. It is especially preferable to use a dielectric polymer which is non-halogenated so as to avoid the generation of toxic or corrosive fumes when the cable is burned. The danger of toxic or corrosive fumes can be even greater than the danger of the fire itself.

An outer conductor 3 surrounds the dielectric spacer 2 and is generally made from a corrugated copper strip which is provided with a series of slots or apertures 4 arranged along the axial length of the conductor. The slots are preferably oval in shape as shown in the drawing, but they can also have other shapes. The radiating apertures 4 in the corrugated copper outer conductor 3 permit a controlled portion of the radio frequency signals being propagated through the cable to radiate from elemental sources along its entire length so that the coaxial cable in effect functions as a continuous antenna.

At least one layer of inert, flame-retardant barrier tape 5A is wrapped around the corrugated outer conductor 3. The radiating cable may be provided with a secondary layer of inert, flame-retardant barrier tape 5B wrapped over the primary layer of tape 5A. An external sheath or jacket 6 made of a highly flame-retardant polymer such as a fluoropolymer is provided over the barrier tape 5. In effect, the tape 5 functions as a barrier between the external jacket 6 and the outer conductor 3 by virtue of which the dielectric material of the spacer 2 is contained within the conductor 3 and prevented from flowing out into contact with the jacket material when the spacer 2 is melted. Even if the material of the outer jacket 6 softens appreciably under high heat conditions, there is no possibility of molten dielectric penetrating the jacket.

The barrier tape 5 has a composition which is capable of serving as an insulating barrier even when exposed to flames with a substantially high temperature (at least up to a temperature of about 1200° C.). In addition, the tape composition is chemically inert, non-toxic and contains no halogenated substances. The composition is also preferably impervious to water, radiation-resistant, acid-resistant and alkaline-resistant. It is also important that the barrier tape have good tensile strength, in addition to being dry, non-tacky, flexible and sufficiently applicable. A preferred composition for the barrier tape comprises an inorganic refractory material such as electric grade mica, which is impregnated with a heat resistant binder and combined with a suitable carrier material such as fiberglass. It is important that the refractory material display a suitably low dissipation factor when used in the cable at the frequencies at which radiating coaxial cables commonly operate. This ensures that the presence of the barrier tape does not significantly affect the electrical characteristics of the cable. Tapes satisfying the above specifications are commercially available under the trade name "FIROX" (trademark) from Cogebi of Belgium.

The manufacturing process involved in producing a radiating cable according to this invention, includes the initial step of applying the dielectric spacer 2 onto an accurately and appropriately sized inner conductor 1 normally made of copper. Subsequently, strip stock of the desired material, generally copper or aluminum, is formed into a tube around the previous assembly and then welded to form the continuous outer conductor 3. The outer conductor 3 is arranged to be coaxial with the inner conductor 1 with the dielectric spacer 2 supporting the outer conductor concentrically on the inner conductor. The outer conductor is annularly or helically corrugated (to provide cable flexibility) with any longitudinal section thereof having alternating crests 3A and troughs 3B. The strip of metal forming the outer conductor may contain the radiating apertures 4 of the desired shape and size before being formed and corrugated around the core assembly. Alternatively, the outer conductor may be positioned around the core assembly and corrugated before milling the radiating apertures therein.

At this stage, the flame-retardant barrier tape 5 is wrapped around the outer conductor 3 in such a way that all the radiating apertures 4 are completely covered by the barrier tape. This wrapping is preferably performed with a fifty percent (50%) overlap so that a double layer of barrier tape is effectively provided over the radiating apertures 4. The entire assembly is subsequently jacketed by extruding the desired fluoropolymer 6 over it.

The fluoropolymer that forms the jacket 6 is extruded over the barrier tape 5. It is preferred that the external jacket material be self-extinguishing and of low dielectric loss. These properties are particularly advantageous in radiating cables. Jacket material possessing the above characteristics is commercially available from Soltex Polymer Corporation under the trade name "SOLEF."

Radiating cables embodying the present invention have been consistently successful when subjected to flame tests prescribed under Standard UL 910 from Underwriters Laboratories Inc. This standard conforms to the well known "Steiner Tunnel" test for plenum cable. In this test a 300,000 Btu flame is applied for 20 minutes to a cable on a horizontal tray inside a tunnel with a 240 fpm draft. The cable fails the test if flame travel exceeds 5.0 feet, or if peak smoke optical density exceeds 0.5, or if average smoke optical density exceeds 0.15. Cables embodying the present invention have passed such tests with a maximum flame propagation distance of 3 to 3.5 feet, peak smoke optical densities of 0.09 to 0.24, and average smoke optical density of 0.01 to 0.06.

We claim:

1. A radiating air-dielectric coaxial cable for electromagnetic radiation in plenum applications, said cable comprising an inner conductor; a non-halogenated dielectric spacer surrounding the inner conductor in direct contact therewith; a single, continuous, outer conductor having a predetermined length and surrounding the dielectric spacer in direct contact therewith, said outer conductor having apertures along its predetermined length for passing of the electromagnetic radiation therethrough; at least one layer of inert, flame-retardant barrier tape wrapped over an outer surface of the outer conductor so as to cover each of said radiating apertures of said outer conductor; and a jacket of highly flame-retardant fluoropolymer extruded over the wrapped layer of barrier tape, said barrier tape functioning as a barrier for preventing said dielectric spacer from melting and flowing out through said radiating apertures into penetrating contact with said jacket.

2. The radiating coaxial cable of claim 1 wherein said dielectric spacer is comprised of a non-flame-retardant polymer.

3. The radiating coaxial cable of claim 1 wherein said dielectric spacer is comprised of a polyolefin.

4. The radiating coaxial cable of claim 1 wherein said dielectric spacer is comprised of low density polyethylene.

5. The radiating coaxial cable of claim 1 wherein said dielectric spacer separates said inner and outer conductors to create an annular space therebetween and wherein said dielectric spacer occupies less than about 5% of the annular space between said inner and outer conductors.

6. The radiating coaxial cable of claim 1 wherein said dielectric spacer is configured substantially in a spiral shape.

7. The radiating coaxial cable of claim 1 wherein said barrier tape is comprised of a particulate refractory material, a heat-resistant binder, and a carrier material.

8. The radiating coaxial cable of claim 7 wherein the refractory material is electric-grade mica and the selected carrier material is fiberglass.

9. A method of providing wireless communication throughout an area containing a plenum, said method comprising the steps of:

providing a radiating coaxial cable including an inner conductor; a non-halogenated dielectric spacer surrounding the inner conductor in direct contact therewith; a single, continuous outer conductor having a predetermined length and surrounding the dielectric spacer in direct contact therewith, said outer conductor having apertures along its predetermined length for passing of electromagnetic radiation therethrough; at least one layer of inert, flame-retardant barrier tape wrapped over an outer surface of the outer conductor so as to cover each of said radiating apertures of said outer conductor; and a jacket of highly flame-retardant fluoropolymer extruded over the wrapped layer of barrier tape, said barrier tape functioning as a barrier for preventing said dielectric spacer from melting and flowing out through said radiating apertures into penetrating contact with said jacket;

positioning said radiating coaxial cable within said plenum; and propagating communications signals through said radiating coaxial cable.

10. A plenum arrangement, comprising:

a plenum; and a radiating coaxial cable disposed within said plenum and including an inner conductor, a non-halogenated dielectric spacer surrounding the inner conductor in direct contact therewith, a single, continuous outer conductor having a predetermined length and surrounding the dielectric spacer in direct contact therewith, said outer conductor having apertures along its predetermined length for passing of electromagnetic radiation therethrough, at least one layer of inert, flame-retardant barrier tape wrapped over an outer surface of the outer conductor so as to cover each of said radiating apertures of said outer conductor, and a jacket of highly flame-retardant fluoropolymer extruded over the wrapped layer of barrier tape, said barrier tape functioning as a barrier for preventing said dielectric spacer from melting and flowing out through said radiating apertures into penetrating contact with said jacket.

11. The radiating coaxial cable of claim 10 wherein said dielectric spacer is comprised of a non-flame-retardant polymer.

12. The radiating coaxial cable of claim 10 wherein said dielectric spacer separates said inner and outer conductors to create an annular space therebetween and wherein said dielectric spacer occupies less than about 5% of the annular space between said inner and outer conductors.

13. The radiating coaxial cable of claim 10 wherein said dielectric spacer is configured substantially in a spiral shape.

14. The radiating coaxial cable of claim 10 wherein said barrier tape is comprised of a particulate refractory material, a heat-resistant binder, and a carrier material.

* * * * *